United States Patent [19]

Vidas

[11] 4,203,338

[45] May 20, 1980

[54] TRUMPET AND SYNTHESIZER APPARATUS CAPABLE OF POLYPHONIC OPERATION

[76] Inventor: Pat Vidas, 3778 Dunhill Rd., Wantagh, N.Y. 11793

[21] Appl. No.: 45,594

[22] Filed: Jun. 4, 1979

[51] Int. Cl.[2] ..... G10H 3/02

[52] U.S. Cl. ..... 84/1.14; 84/1.24; 84/445

[58] Field of Search ..... 84/1.04, 1.14, 1.24, 84/445

[56] References Cited

U.S. PATENT DOCUMENTS

| | | | |
|---|---|---|---|
| 2,138,500 | 11/1938 | Miessner | 84/1.04 X |
| 2,984,140 | 5/1961 | Barron | 84/1.04 |
| 3,429,976 | 2/1969 | Tomcik | 84/1.04 X |
| 3,482,026 | 12/1969 | Babicky | 84/1.04 X |
| 3,507,971 | 4/1970 | Feddersen | 84/1.14 |
| 3,510,564 | 5/1970 | Wetsell et al. | 84/1.04 |
| 3,543,629 | 12/1970 | Barcus et al. | 84/1.14 |
| 3,767,833 | 10/1973 | Noble et al. | 84/1.24 X |
| 3,938,419 | 2/1976 | De Rosa | 84/1.14 |

*Primary Examiner*—S. J. Witkowski

*Attorney, Agent, or Firm*—Arthur L. Plevy

[57] ABSTRACT

There is disclosed a trumpet incorporating rotary potentiometers which are controlled by means of circular wheels coupled to the shaft of the potentiometers. By rotating the wheel, the musician can vary the resistance of the potentiometer to thereby control the modulation and pitch characteristics of a synthesizer. The pitch of the trumpet is transduced by means of a pickup located in the mouthpiece of the instrument. The signal produced by the pickup is coupled to a pitch follower circuit whose output is coupled to the external input of a synthesizer module to hence use the actual pitch of the trumpet to vary the characteristics of the synthesizer. A transposition switch is located on the rear valve assembly and operates to control the transposition mode of the pitch follower. A glide switch is positioned beneath the transposition switch and is employed to control the portamento input of the synthesizer module. The instrument, when operating in conjunction with a conventional synthesizer, produces a polyphonic output which presents to a listener, the sound of a multiplicity of instruments.

10 Claims, 3 Drawing Figures

Fig.2.
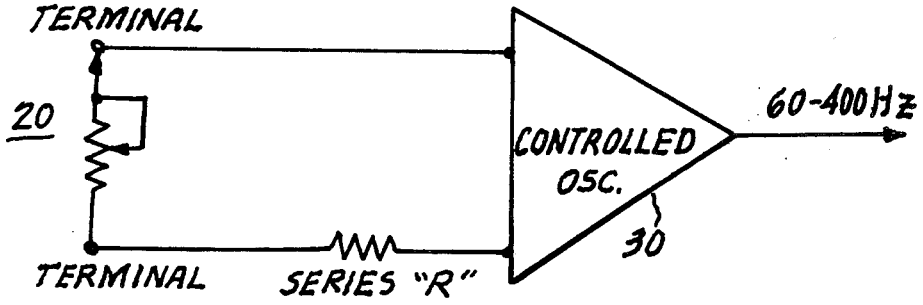
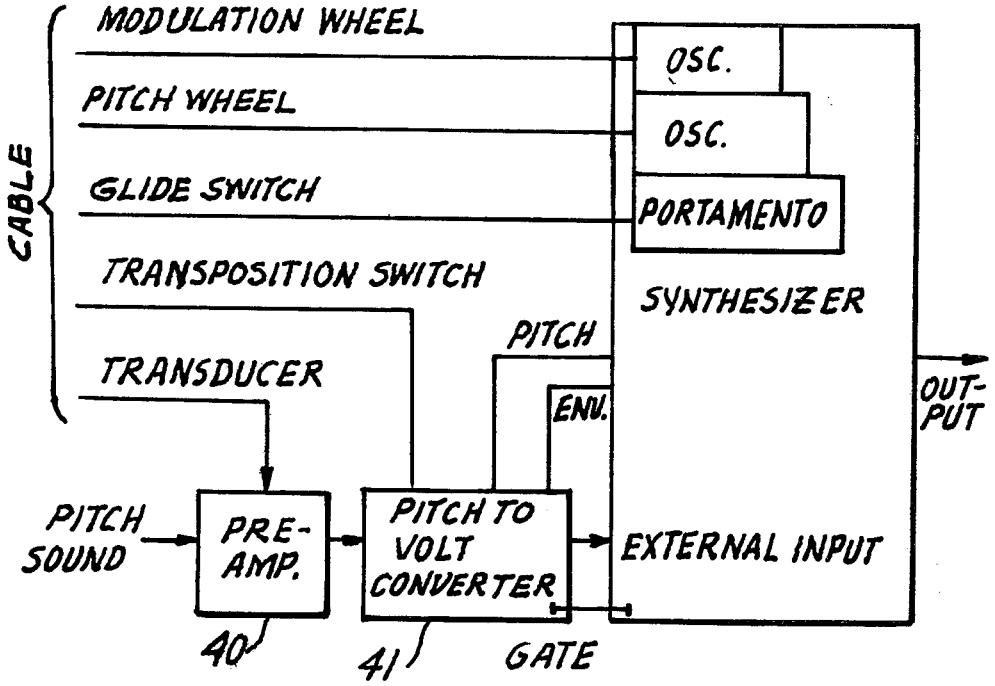
Fig. 3.

TRUMPET AND SYNTHESIZER APPARATUS CAPABLE OF POLYPHONIC OPERATION

BACKGROUND OF INVENTION

The present invention relates in general to musical instruments and more particularly to a trumpet or brass instrument which employs apparatus for synthesizing sound.

The field of synthesizers for musical instruments is quite extensive and such devices have been employed with a wide variety of musical instruments and especially such devices as organs and pianos. The primary function of a synthesizer in a musical instrument is to control the frequency of the sound in a predetermined manner.

It is known that a musical instrument such as a trumpet which is a brass instrument, can provide sounds within the frequency range of about 250 Hz to about 700 Hz. In fact, the frequency distribution and peak power of such instruments have been documented in various textbooks. A textbook entitled RADIO ENGINEERING HANDBOOK by Henney (5the Edition) McGraw-Hill Co. in Chapter 11 contains various charts and tables indicating the frequency range of various instruments used in an orchestra. With the advent of modern music plus the use of electronics in regard to music, it is extremely desirable to employ a synthesizer capability in the use of wind instruments.

Various attempts have been implemented in the prior art to employ a synthesizer with a wind instrument. Hence, U.S. Pat. No. 3,938,419 issued on Feb. 17, 1976 to DeRosa shows a synthesizer which functions in conjunction with a trumpet. Essentially, the opening and closing of the valves of the instrument activates a series of switches which are coupled to the valves and allow one to control the frequency of an oscillator according to the particular valves depressed. This unit is extremely limited in operation and requires a substantial modification of the trumpet.

Other units as shown in U.S. Pat. No. 3,429,976 attempt to control sound by employing a threshold circuit in conjunction with the mouthpiece of the instrument to attempt to produce various sounds by generating control signals for an external synthesizer. The problem with such prior art devices is that they do not truly provide a widespread band of frequencies and they are difficult to implement and control.

A major aspect of a synthesizer is the ability to allow the musician to control the unit according to his preferences and skills. The controls must be such that they can be easily operated by the musician while he is further playing the instrument in the ordinary and typical manner. In regard to such an instrument, it is desirable to vary the notes emnating from the trumpet through several octaves and to do so in a completely reliable and efficient manner. In this way, the trumpet can be played in a conventional mode, while the full effects of a synthesized signal can be provided strictly under the control of the player.

BRIEF DESCRIPTION OF THE PREFERRED EMBODIMENT

A combination adapted for use with a valve controlled brass instrument of the wind type and a synthesizer module associated therewith, with said instrument providing said synthesizer control signals for operating the same, with a first potentiometer mounted on said instrument and controllable in resistance by means of a first rotatable wheel coupled to said potentiometer for providing a variable resistance change manifesting a pitch control signal for said sythesizer, a second potentiometer mounted on said instrument with a second wheel coupled to said second potentiometer with said second wheel positioned transverse to said first wheel for varying the resistance of said second potentiometer manifesting a modulation control signal for said synthesizer.

BRIEF DESCRIPTION OF THE FIGURES

FIG. 2 is a schematic diagram of a controlled oscillator circuit.

FIG. 3 is a block diagram showing the routing of the leads emanating from the switches and controls of FIG. 1 into a synthesizer system according to this invention.

DETAILED DESCRIPTION OF INVENTION

Figure 1:
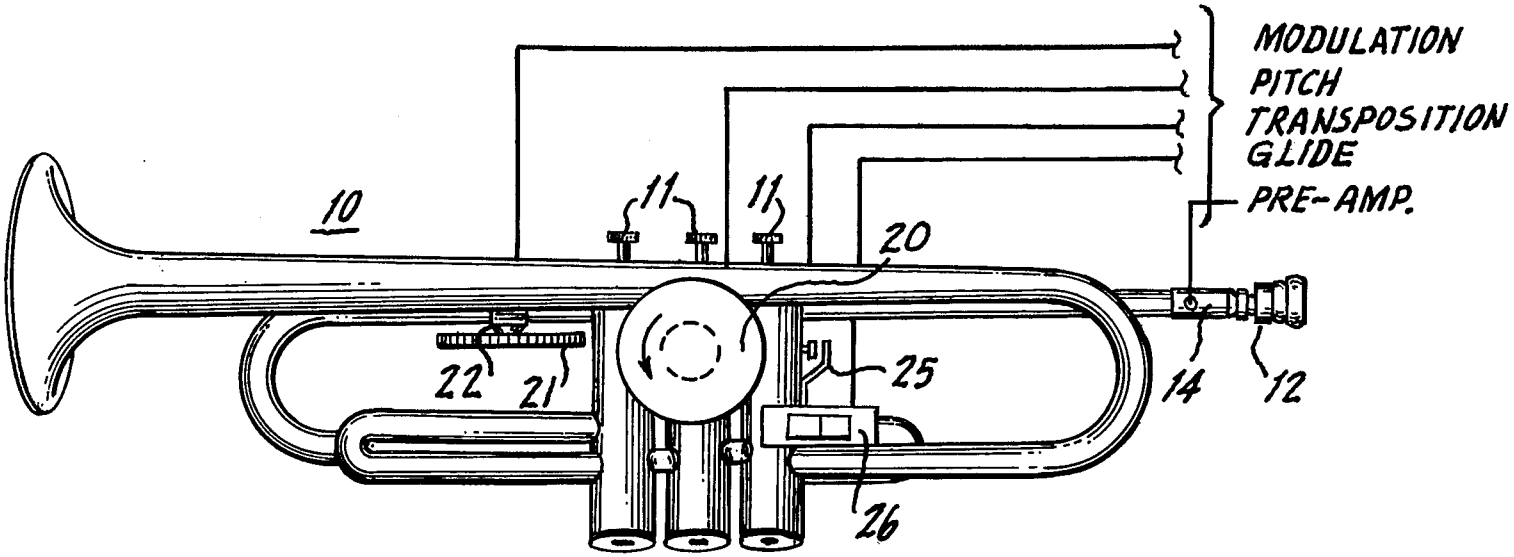
FIG. 1 is a perspective view of a trumpet employing control wheels and switches according to this invention.

Referring to FIG. 1, there is shown a typical trumpet 10. The typical trumpet has a series of valves 11 which are depressed to allow the musician to produce a variety of notes. It is, of course, understood that the valves shown are typical and are associated with most trumpets.

The trumpet also has a mouthpiece 12 which the musician blows into to produce the required sound. As indicated, the trumpet 10 is relatively conventional.

Referring to FIG. 1, mounted on the body of the trumpet adjacent the valves 11 is a rotatable wheel assembly 20. Essentially, the wheel assembly consists of a rotatable potentiometer; which device varies its resistance according to the rotation.

As is known, potentiometers exist and are manufactured by many companies, such as the Allen Bradley Co. The potentiometer is secured to the body of the trumpet by means of any suitable clamp assembly. The rotatable shaft of the potentiometer is coupled to a large circular wheel as 20 which may be fabricated from a suitable metal or plastic. The wheel 20 is manipulated or rotated by the musician with his support hand and thus as the wheel 20 is rotated, the resistance of the potentiometer varies. This change in resistance is used as an input to typical synthesizer modules to vary or control the frequency of an associated oscillator. It is understood at the outset that such components as 20 are mounted directly on the instrument by means of suitable brackets or other mechanical arrangements; many examples of which should be known to those skilled in the art.

Located in front of the valves is another wheel (shown in side view). This wheel also is coupled to a potentiometer 22 and as the wheel 21 is rotated, the resistance of the potentiometer also changes. As shown, the wheel 21 is mounted in front of the valves, while the wheel 20 is mounted on the left side of the trumpet adjacent the valves.

There is further shown a switch 25 which will be referred to as a transposition switch. This switch is mounted on the valve assembly and can be thumb operated to provide an opened or closed circuit. Located beneath the switch 25 is another switch 26 which is a glide switch. The switch 26 can be activated by the musician to enable control of the portamento input of the synthesizer.

Coupled to the mouthpiece of the instrument 12 is a transducer 14. Basically, the transducer converts the mechanical vibrations of the mouthpiece into an electrical signal. The transducer may be a piezoresistive device or may be a typical diamond head pickup. In this manner, the actual pressure variations being produced by the lips of the trumpet player are converted to an electrical signal which can be coupled to conventional synthesizer units, as will be explained.

Hence, as shown in FIG. 1, there are cables emanating from each of the above described control devices and these cables are directed to suitable electronic units in order to provide and produce the appropriate sounds. It is understood that a main advantage of the above described components is that the player can manipulate these components with, for example, his left hand in the case of a right handed player. The addition of these components does not alter the way the instrument is held and the right hand of the musician still functions to control the depression of the various valves, while the left hand which is used mainly to support the weight of the instrument, is now employed to operate the various wheels and switches.

As shown in FIG. 2, a potentiometer as 20 and 21 of FIG. 1 may be used to vary the frequency of a controllable oscillator 30. There are many examples of voltage controlled oscillators which can be operated by a change in resistance. The potentiometers associated with the wheels 20 and 21 both function to control an oscillator as 30. The oscillator may be selected to produce a frequency range within the band of sixty to four hundred cycles and is controllable by the resistance of potentiometer 20, for example, which would be associated with the tone wheel 20 of FIG. 1. Essentially, any commercially available potentiometer would be suitable. By varying the potentiometer and hence the resistance, this allows the performer to tune oscillators located in a synthesizer module within any frequency range desired.

Shown in FIG. 3 is a schematic diagram of a typical synthesizer module; which modules are commercially available and are used mainly with keyboards such as those associated with a piano or an organ.

The leads from potentiometer 22 of FIG. 1 are designated as modulation wheel as potentiometer 22 is controlled by the rotatable wheel 21. This input goes directly into the control terminals of a synthesizer to control a first oscillator. In a similar manner, the leads from potentiometer 20 are referred to as the pitch wheel and these leads are coupled to the synthesizer module to control an additional oscillator.

The two leads emanating from switch 26 which is the glide switch, are coupled to the portamento input of the synthesizer. The transducer 14 has its lead coupled to a preamplifier 40. The output of the preamplifier is directed into a pitch to voltage converter circuit 41. Pitch to voltage converters are also well known in the art and many examples of such systems can be used.

The output from the transposition switch 25 is coupled to the transposition input of the pitch of voltage converter via the two leads shown in FIG. 3. The output of the pitch to voltage converter is connected to the external input of the synthesizer. The gate control is also connected to the gate input of the synthesizer module, while the pitch envelope output of the pitch to voltage converter is connected to the pitch envelope inputs of the synthesizer.

A typical synthesizer which can be employed which has such inputs is a synthesizer module referred to as the Moog synthesizer. The inputs described in FIG. 3 as associated with the synthesizer are known and available. The pitch to voltage converter as shown in FIG. 3 is also a conventional unit and can be obtained from a company called "360 Systems". Such pitch to voltage converters allow accentuation of the synthesizer units to provide a distinct sound.

With the use of the synthesizer oscillators as controlled by the pitch and modulation wheels 20 and 21, the instrument becomes polyphonic. In this manner, the trumpet employing such controls has a range of four octaves up and four octaves down and any interval inbetween. These ranges can be achieved by use of the pitch wheel. With the use of the pitch follower in conjunction with the transducer mouthpiece and employing the control wheels, a skilled musician can simulate the sounds of three or four instruments at once. In this manner, a listener immediately receives the impression that a plurality of instruments are being played by a single musician.

The pitch to voltage converter, as indicated, employs a transposition input. Switch 25 automatically enables or disables this input. In this manner, the performer can implement transposition any time he desires by merely activating switch 25.

The modulation potentiometer may have a resistance that varies between zero to 25,000 Ohms. This resistance, when connected to the synthesizer terminals can control a typical Moog oscillator from zero to 1,000 Hz. The modulation wheel 21 therefore enables the player to control the low frequency modulation of any given type of synthesizer.

The glide switch or portamento switch 26 enables a musician to create the effect of sliding into the musical tones by actuation of the switch and is coupled to the appropriate inputs of the synthesizer.

As indicated, the pitch of the trumpet is responded to by the transducer 14 which is a conventional pickup. An example of a suitable transducer is a Barcus-Berry diamond head pickup. The input from this transducer is amplified by a conventional preamp and is used to drive the pitch to voltage converter. The output of the pitch to voltage converter is conventionally applied to the external input of the synthesizer where it is operated on according to synthesizer format.

The unique characteristic of the trumpet shown in FIG. 1 is that the controls enable a musician to couple the trumpet to any conventional type of synthesizer and to thereby obtain the advantages of using such a synthesizer in conjunction with a trumpet or wind instrument. It is therefore indicated that the use of the trumpet as shown in FIG. 1 enables a trumpet player to couple the device to a conventional synthesizer module.

It is noted that the potentiometer 21 as rotated by the wheel controls the modulation of the synthesizer and those oscillators associated with the synthesizer for modulation control. The second wheel 20 is used as a pitch control and also serves to vary the frequency of additional oscillators included in a synthesizer. The pitch of the trumpet is converted to an electrical signal by the transducer 14; which signal is coupled to a pitch follower. The pitch follower is also controlled to operate in its transposition mode by the use of the transposition switch 25. The glide switch 26 which is also positioned on the trumpet, enables control of the portamento of the synthesizer.

In this manner, with the addition of the above noted components on a conventional trumpet, a musician can manipulate the above described controls with the hand normally employed to hold the instrument. The other hand, as is conventional, is then used to activate the valves of the trumpet and hence, the trumpet is played in the ordinary manner.

It is further noted that the actual sounds which emanate from an ordinary trumpet via the flare end still emanate and are still produced in this trumpet. This occurs simultaneously with the control of the synthesizer module as implemented by the above described switches and potentiometers. The instrument thus has the capability, in conjunction with the synthesizer, of producing polyphonic sound and thus creates the impression that a multiplicity of wind instruments are being played by the single instrument and synthesizer above described.

I claim:

1. A combination adapted for use with a valve controlled brass instrument of the wind type and a synthesizer module associated therewith, with said instrument providing said synthesizer control signals for operating the same, with a first potentiometer mounted on said instrument and controllable in resistance by means of a first rotatable wheel coupled to said potentiometer for providing a variable resistance change manifesting a pitch control signal for said synthesizer, a second potentiometer mounted on said instrument with a second wheel coupled to said second potentiometer, with said second wheel positioned transverse to said first wheel for varying the resistance of said second potentiometer manifesting a modulation control signal for said synthesizer.

2. The combination according to claim 1 further including a pitch to voltage converter having an output adapted to be coupled to an external input of said synthesizer, said instrument having positioned thereon, a transducer coupled to the mouthpiece of said instrument for converting air pressure into an electrical signal, with the output of said transducer coupled to the input of said pitch to voltage converter for providing an output signal to said synthesizer.

3. The combination according to claim 2 wherein said pitch to voltage converter has a transposition input terminal with an on-off switch mounted on said instrument and having output terminals coupled to said transposition input terminals to enable operation of a transposition mode by said operator closing or opening said switch.

4. The combination according to claim 1 further including a glide switch assembly mounted on said instrument and positioned in proximity to said first wheel and operative when switched to provide a portamento input for said synthesizer.

5. The combination according to claim 1 wherein said instrument is a trumpet, having a front flared end and a back end including a mouthpiece for impressing a pressurized air stream into said instrument, with a valve assembly located between said front and back ends for selectively controlling the sound produced by said air stream under control of the musician.

6. The combination according to claim 5 wherein said transducer as coupled to said mouthpiece is a diamond head pickup.

7. The combination according to claim 2 further including a preamplifier having input terminals and output terminals for providing an amplifier signal at said output terminals, and means coupling said transducer to said input terminals with said output terminals coupled to the input terminals of said pitch to voltage converter.

8. In combination:

(a) a trumpet having located thereon, a first potentiometer having output terminals and capable of providing a variable resistance upon rotation of a shaft associated therewith, a first control wheel coupled to said shaft and positioned relatively parallel to said valve assembly of said trumpet and on the left side, (b) a second potentiometer having output terminals and located on said trumpet and capable of providing a variable resistance upon rotation of a shaft associated therewith, a second control wheel coupled to said shaft and positioned in front of said valve assembly and transverse to said first wheel, whereby a user of said instrument can rotate said first or second wheels with his support hand, while activating said valve assembly with his other hand.

9. The combination according to claim 8 further including a synthesizer module having a first set of input terminals coupled to said output terminals of said first potentiometer and a second set of input terminals coupled to said output terminals of said second potentiometer.

10. The combination according to claim 8 further including a first switch having an opened and closed position mounted on said valve assembly, and a second switch mounted on said trumpet beneath said first switch.

* * * * *